US010273708B2

(12) United States Patent
Holst et al.

(10) Patent No.: US 10,273,708 B2
(45) Date of Patent: Apr. 30, 2019

(54) MAST TRANSPORT SKID

(71) Applicant: PATTERSON-UTI DRILLING COMPANY LLC, Snyder, TX (US)

(72) Inventors: Katherine J. Holst, Houston, TX (US); Michael F. Jones, Conroe, TX (US); Tyson Andrew Springer, Edmonton (CA); Kristopher Landon Murray Butler, Edmonton (CA); Bradley James Schroeder, Edmonton (CA); Christopher Medland, Edmonton (CA)

(73) Assignee: PATTERSON-UTI DRILLING COMPANY LLC, Synder, TX (US)

( * ) Notice: Subject to any disclaimer, the term of this patent is extended or adjusted under 35 U.S.C. 154(b) by 393 days.

(21) Appl. No.: 14/639,842

(22) Filed: Mar. 5, 2015

(65) Prior Publication Data

US 2016/0258178 A1 Sep. 8, 2016

(51) Int. Cl.

| | |
|---|---|
| ***B66C 23/06*** | (2006.01) |
| ***E04H 12/34*** | (2006.01) |
| ***E04H 12/18*** | (2006.01) |
| ***E21B 15/00*** | (2006.01) |

(52) U.S. Cl.

CPC ..... *E04H 12/345* (2013.01); *E04H 12/182* (2013.01); *E04H 12/187* (2013.01); *E21B 15/00* (2013.01); *E21B 15/003* (2013.01)

(58) Field of Classification Search

CPC ..... E04H 12/345; E04H 12/187; E21B 15/00
USPC ..... 52/116, 118, 123.1, 111
See application file for complete search history.

(56) References Cited

U.S. PATENT DOCUMENTS

| | | | | |
|---|---|---|---|---|
| 4,249,600 | A | 2/1981 | Bailey | |
| 4,269,395 | A * | 5/1981 | Newman | E21B 7/023 173/147 |
| 4,759,414 | A | 7/1988 | Willis | |
| 4,821,816 | A | 4/1989 | Willis | |
| 4,899,832 | A * | 2/1990 | Bierscheid, Jr. | E21B 19/14 173/184 |
| 6,634,436 | B1 * | 10/2003 | Desai | E21B 15/00 173/1 |
| 6,994,171 | B2 * | 2/2006 | Orr | E21B 15/00 173/1 |
| 8,046,959 | B2 | 11/2011 | Stoetzer et al. | |
| 8,353,132 | B1 | 1/2013 | Vogt et al. | |
| 8,549,815 | B2 | 10/2013 | Donnally et al. | |
| 8,646,240 | B1 | 2/2014 | Patrick et al. | |
| 8,720,128 | B2 | 5/2014 | Vogt | |
| 8,904,716 | B2 * | 12/2014 | Donnally | E21B 15/00 52/111 |
| 9,284,168 | B2 * | 3/2016 | Mau | B66C 23/78 |

(Continued)

FOREIGN PATENT DOCUMENTS

WO 2012092147 A2 7/2012

OTHER PUBLICATIONS

PCT International Search Report for PCT International Patent Application No. PCT/US2016/018290, dated Jul. 26, 2016.

*Primary Examiner* — Basil S Katcheves
(74) *Attorney, Agent, or Firm* — Holland & Hart

(57) ABSTRACT

A transportable unit has a skid with a pivot connector to pivotally attach to a first mast leg of a drill rig mast. The skid also has a support connector to attach to a second mast leg support of the drill rig mast and a substructure connector to attach to a substructure of a drill rig.

8 Claims, 9 Drawing Sheets

(56) References Cited

U.S. PATENT DOCUMENTS

| | | | | |
|---|---|---|---|---|
| 2004/0211598 | A1* | 10/2004 | Palidis | E21B 15/00 175/162 |
| 2005/0193645 | A1 | 9/2005 | Barnes | |
| 2005/0194189 | A1* | 9/2005 | Barnes | E21B 7/02 175/122 |
| 2006/0213653 | A1* | 9/2006 | Cunningham | E21B 7/024 166/77.1 |
| 2009/0000218 | A1* | 1/2009 | Lee | E21B 15/00 52/123.1 |
| 2011/0072737 | A1 | 3/2011 | Wasterval | |
| 2012/0138327 | A1* | 6/2012 | Sorokan | E21B 7/02 173/189 |
| 2012/0167485 | A1 | 7/2012 | Trevithick et al. | |
| 2013/0269268 | A1* | 10/2013 | Thiessen | E21B 15/00 52/118 |

* cited by examiner

MAST TRANSPORT SKID

BACKGROUND

The expense of transporting and setting up drilling rigs at different drill sites can be time consuming and costly. Transporting the equipment for drilling oil and gas wells is often costly because such equipment is heavy and bulky. For example, modular drill rigs often include a mast of over a hundred feet when fully erected, a drilling floor, and a substructure to support the drilling floor and mast. The substructure raises the drilling floor off of the ground at a sufficient height to accommodate drill equipment connected to the well bore, such as a blowout preventer.

Transporting the rig generally includes disassembling the components of the drill rig into manageable loads that meet government regulations for transport on truck beds and trailers. At the new drill site, the rigs are assembled in place before the well head equipment is positioned in place.

One type of modular rig is disclosed in U.S. Pat. No. 8,720,128 issued to Dewayne G. Vogt. In this reference, a method to disassemble a mast assembly having a substructure including a first and second section, a first and a second cylinder, and a lower mast section. The method includes the steps of disengaging a pair of front mast legs of the lower mast section from a pair of front leg supports. The pair of front leg supports are moved from an operational to a transport position. The lower mast section is lowered from a vertical to a horizontal position by retracting the first cylinder and the second cylinder. A mast center spreader is thereafter removed from the lower mast section. A center drill floor section is removed from between the first substructure section and the second substructure section so that a combination of the first substructure section, the first cylinder and a portion of the lower mast and a combination of the second substructure section, the second cylinder and a portion of the lower mast may be transported. Another type of system is described in U.S. Patent Application No. 2012/0167485 issued to Mark W. Trevithick, et al. All of these documents are herein incorporated by reference for all that they contain.

SUMMARY

In one aspect of the principles described herein, a transportable unit has a skid. The skid has a pivot connector to pivotally attach to a first mast leg of a drill rig mast, and the skid also has a mast leg support connector to attach to a second mast leg support of the drill rig mast. The skid also has a substructure connector to attach to a substructure of a drill rig.

In some examples, the skid also includes a cylinder attachment to connect a first end of a cylinder. A second end of the cylinder is connected to the drill rig mast. The cylinder may be arranged to raise and lower the drill rig mast. Further, in some cases, the transportable unit includes a cylinder with a first cylinder end attached to the skid and a second cylinder end attached to the drill rig mast section. The cylinder may be a single stage cylinder. The pivot connector may be elevated between 5.0 and 15.0 feet above a floor of the skid by a pivot support. A second mast leg support may be connected to a second leg of the mast at a joint at a first end when a second end of the second mast leg support is rotated towards the mast.

In another aspect of the principles described herein, a transportable unit has a mast transport skid, a drill rig mast pivotally attached to the mast transport skid, and a cylinder with a first cylinder end attached to the mast transport skid and a second cylinder end attached to the mast section. The skid has a pivot connector attached to a first mast leg of a drill rig mast. Also, the skid has a support connector to attach to a second mast leg support of the drill rig mast and a substructure connector to attach to a substructure of a drill rig.

In yet another aspect of the principles described herein, a method includes disconnecting a front mast leg support from a mast transport skid, lowering a mast section of the drill rig to align with a mast transport skid by retracting a cylinder connected to the mast section and the mast transport skid, and disconnecting the mast transport skid from a drill rig substructure to form a transportable unit that includes the mast transport skid, the cylinder, and the mast section.

The method may include connecting a first end of a cylinder to the mast transport skid where the second end of the cylinder is already attached to the mast section. The method may also include moving a releasable end of the front mast leg support towards the mast section. Moving the releasable end of the front mast leg support toward the mast section may occur simultaneously with lowering the mast section. Also, moving the releasable end of the front mast leg support towards the mast section may include rotating the front mast leg support about a joint formed between the front mast leg support and the front leg of the mast section. Lowering the mast section may include pivoting a back leg of the mast section about a pivot connector elevated 5.0 to 15.0 feet above a floor of the mast transport skid with a pivot support.

In an additional aspect of the principles described herein, a method for assembling a drill rig includes connecting a mast transport skid to a substructure where the mast transport skid forms a transportable unit with a mast cylinder and a mast section of the drill rig where the first end of the cylinder is attached to the mast transport skid and a second end of the cylinder is attached to the mast section, raising the mast section to be oriented in an upright position by extending the mast cylinder; and connecting a releasable end of the front mast leg support to the mast transport skid at a support connector.

The method may also include disconnecting the first end of the cylinder from the mast transport skid, and retracting the cylinder into the mast section.

The method may also include moving the releasable end of the front mast leg support to the support connector. Moving the front mast leg support may occur simultaneously with raising the mast section. Moving the front mast leg support may include rotating the front mast leg support about a joint between the front mast leg support and a front leg of the mast section. Raising the mast section may include pivoting a back leg of the mast section about a pivot connector elevated 5.0 to 15.0 feet above a floor of the mast transport skid with a pivot support. In some examples, the cylinder is a single stage cylinder.

Any of the aspects of the principles detailed above may be combined with any of the other aspect detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

The process of disassembling the components of the drill rig, transporting the drill rig, and reassembling the components of the drill rig are time consuming and costly. Reducing the number of task for disassembling and assembling the drill rig can speed up the process of moving the drill rig and thereby make the drill rig more productive and profitable. The principles described in the present disclosure include methods for assembling and disassembling drill rigs that shorten the process of setting up and taking down drill rigs. For example, the principles described herein include a mast transport skid that is incorporated into the drill rig. Such a mast transport skid remains in the drill rig after the drill rig is set up and during the operation of the drill rig. The mast transport skid is constructed to span between substructure columns. In some cases, the mast transport skid is supported by a beam that spans the distance between the substructure columns. The mast transport skid can be easily attached and/or disconnected to the substructure columns at the drill site.

The mast transport skid is pivotally connected to the lower mast section and to the cylinder that is used to raise and lower drill rig mast. During disassembly, the lower mast section and the cylinder for raising and lowering the lower mast section remain connected to the mast transport skid. Thus, the mast transport skid, the cylinder, and the lower mast section form a transportable unit that is capable of being transported on truck trailers. The mast transport skid can be easily transferred from the trailer to the top of the substructure column. When the mast transport skid is in place, the cylinder can be extended raising the lower mast section into an upright position. Other portions of the mast, such as an upper mast portion and a middle mast portion are typically connected to the lower mast section when the lower mast section is raised, thus these portions of the mast are also raised with the lower mast section. The mast transport skid and the methods described herein eliminate several tasks involved with disassembling and assembling drill rigs. For example, having to install the cylinder and having to connect the mast legs to a pivot portion of the drill rig are eliminated. Thus, the set up and take down of the drill rig is reduced making the drill rig more efficient and profitable.

For purposes of this disclosure, the term "aligned" means parallel, substantially parallel, or forming an angle of less than 35.0 degrees. Also, for purposes of this disclosure, the term "transverse" means perpendicular, substantially perpendicular, or forming an angle between 55.0 and 125.0 degrees. Further, for purposes of this disclosure, the term "length" refers to the longest dimension of an object.

Figure 1:
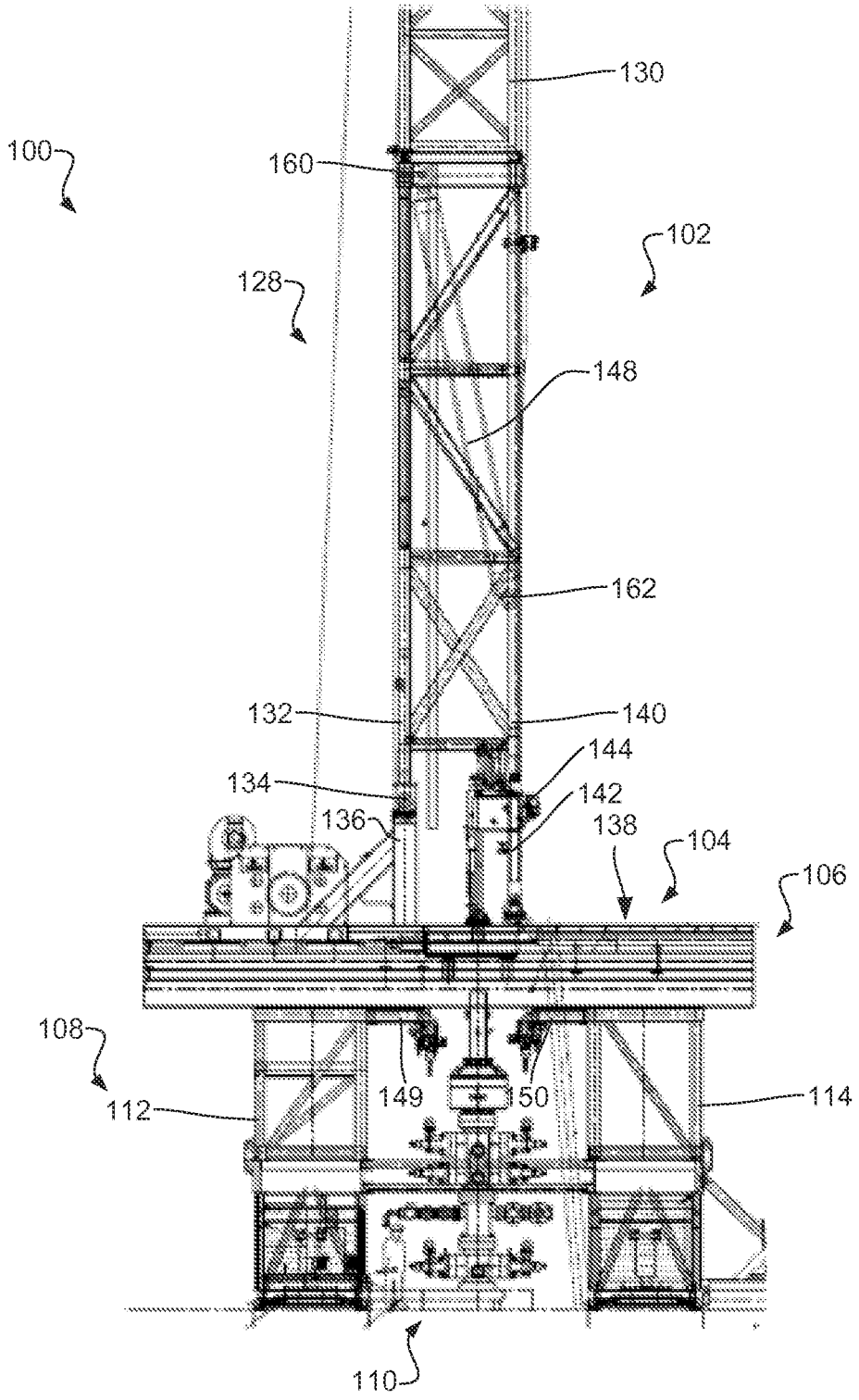
FIG. 1 illustrates a drillers' side view of an example of a drill rig with a mast erected in an upright position in accordance with the present disclosure.
Figure 2:
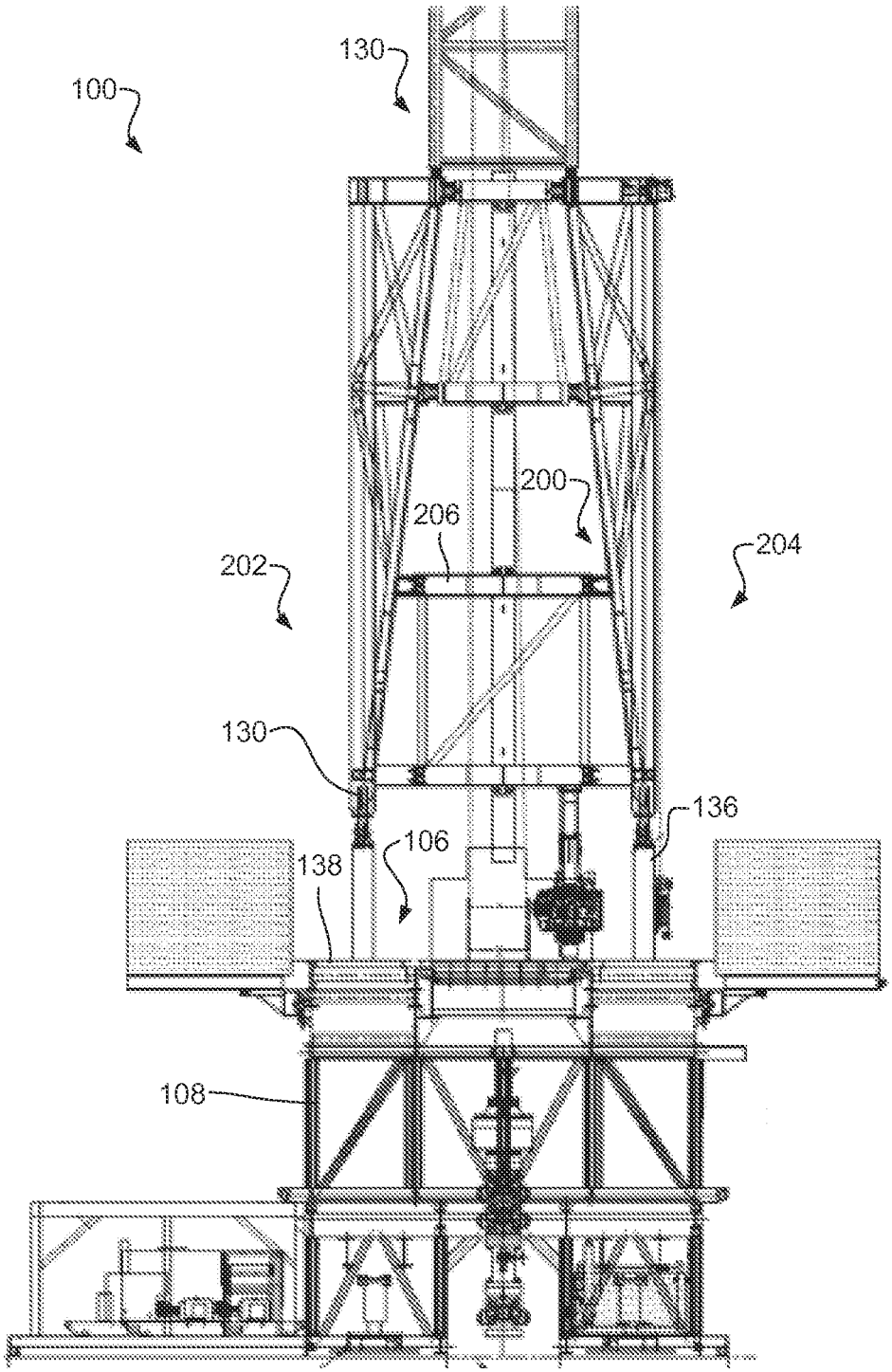
FIG. 2 illustrates a V-door side view of an example of a drill rig with a mast erected in an upright position in accordance with the present disclosure.

Particularly, with reference to the figures, FIGS. 1-2 depict a drill rig 100 in accordance with the present disclosure. In these examples, the drill rig 100 includes a mast 102, a drill floor 104, a mast transport skid 106, and a substructure 108. The substructure 108 supports the mast 102, the drill floor 104, and the mast transport skid 106. The substructure 108 raises the drill floor 104 and mast transport skid 106 to an elevation high enough to accommodate a blowout preventer 110 that is positioned over the wellbore.

In the illustrated examples, the substructure 108 includes at least a first box substructure 112 and a second box substructure 114. The box substructures 112, 114 each include a box frame that includes multiple trusses. The substructure 108 supports the weight of the mast 102, the drill floor 104, the mast transport skid 106, the drill string, personnel operating the drill rig 100, and other equipment. Thus, the substructure 108 can be capable of supporting millions of pounds. In some cases, multiple box substructures are placed on top of each other forming a box on box substructure. However, the principles described herein may be used for any appropriate type of substructure including, but not limited to, skid and trailer type substructures, slingshot type substructures, spin-up type substructures, telescope type substructures, modular type structures, other appropriate type substructures, or combinations thereof.

The mast 102 of the drill rig may include multiple sections. In the illustrated examples, the mast 102 includes a lower mast section 116. The lower mast section 116 includes a V-door 200 incorporated on a front side of the drill rig 100. The V-door 200 is an opening in the lower mast section 116 and is located on the drill floor 104 opposite to the drawworks, which sits on the back side of the drill rig floor. The V-door is used as an entry point to bring in drill pipe, casing, and other tools involved with drilling operations. The lower mast section includes a driller's side subsection 202 and an off driller's side subsection 204, which can be separated from each other during disassembly by removing the spreader beams 206 located on the back side 128 of the lower mast section 116. Additional mast sections, such as top mast sections or middle mast sections 130, can be added to the mast 102. Such additional mast sections can be added to the lower mast section 116 before the lower mast section 116 or after the lower mast section 116 is in an upright position.

The back legs 132 of both of the side subsections 202, 204 of the lower mast assembly 116 may be connected to pivot connectors 134. Such pivot connectors 134 may be raised off of the drill floor 104 by pivot supports 136. In some examples, the pivot supports 136 are rigidly affixed to the mast transport skid 106. As the mast 102 is raised and lowered, the lower mast section 116 may pivot about the pivot connectors 134. The pivot supports 136 may elevate the pivot connectors 134 to a height that is 5.0 to 15.0 feet above the drill floor 104 and/or a mast transport skid's surface 138.

The front mast legs 140 of the lower mast section 116 are attached to front mast leg supports 142. The front mast legs 140 may form a joint 144 with the front mast leg supports 142. The front mast leg supports 142 may be attached to front support connectors integrated into the mast transport skid 106. When disconnected from the front support connectors, the front mast leg supports 142 can rotate about the joint 144. For example, when the lower mast section 116 is lowered into a position aligned with the mast transport skid 106, the lower mast assembly 116 may be lowered with the front side down. In such an example, the front mast leg supports 142 remain connected to the front mast legs 140 and therefore travel with the lower mast section 116. The front mast leg supports 142 can be rotated towards the lower mast section 116 about the joint 144 as the lower mast section 116 is being lowered. As the lower mast section 116 is lowered, the back legs 132 of the lower mast section 116 rotate about the pivot connector 134. Thus, in the lowered, aligned position, the back legs 132 of the lower mast section 116 are facing upward and are raised off of the mast transport skids 106 by the pivot supports 136.

In the example of FIG. 1, a cylinder 148 is depicted in the lower mast section 116. A first end 160 of the cylinder 148 is connected to the lower mast section 116, and a second end 162 of the cylinder 148 is also shown in the lower mast section 116. This cylinder 148 may be used to raise and lower the lower mast section 116 by attaching the second end 152 of the mast transport skid 106. With the first end 160 of the cylinder 148 attached to the mast 102 and the second end 162 attached to the mast transport skid 106, the mast 102 can be raised by extending the cylinder 148. Likewise, the mast 102 can be lowered by retracting the cylinder 148.

In some examples, the cylinder 148 is a single stage cylinder. Such single stage cylinders generally have a simpler construction and are more robust than conventional multi-stage cylinders. In conventional modular drill rigs, multi-stage cylinders are used because the cylinders often need a longer stroke to raise the mast. However, in the illustrated example, the pivot connector 134 of the back legs 132 is raised off of the mast transport skid 106 by 5.0 to 15.0 feet, which reduces the moment on mast 102 as the mast 102 is raised. As a result, the clear height (the height from the pivot connector 134 to the top of the mast) is low enough that a single stage cylinder is capable of raising the mast 102. In one example where the mast 102 includes the lower mast section 116, a middle mast section 130, and a top mast section, the clear height of the mast may be about 142.0 feet. However, the mast 102 may include any appropriate clear height. For example, the clear height may be between 100.0 and 160.0 feet, another height, or combinations thereof.

After the mast 102 has been oriented in the upright position, the second end 162 of the cylinder 148 may be disconnected from the mast transport skid 106 and retracted into the mast 102. With the cylinder 148 in the retracted position, the cylinder 148 is positioned to be out of the way of drilling operations. For example, leaving the cylinder 148 extended with the cylinder's rod exposed may put the surface material of the cylinder's rod at risk. Some types of drilling mud may chemically react with the chrome of certain cylinder rods and retracting the cylinder 148 into the mast 102 may prevent drilling mud from making contact with the cylinder rod. Additionally, the cylinder's chrome face is also protected from coming into contact with other pieces of equipment by being retracted into mast 102.

A drill string is made of multiple drill pipes and other drill string components threaded together at pipe joints. A drill bit is often secured to the front of the drill sting such that when the drill string is rotated against the formation under a load, a bore hole is formed. The bottom components of the drill string are first lowered through an opening in the blowout preventer 110, which initially guides the drill bit to form the bore hole in the correct location. As the drill bit creates the bore hole, the drill string advances into the formation. Additional drill pipe are added to the drill string as the drill string advances into the formation. As the drill string is lengthened by adding more drill pipe, the weight of the drill string increases.

Further, as the drill bit advances through various subterranean formations, the down hole pressures exerted on the drill string change. For example, the drill string may encounter a high pressure pocket of gas or oil trapped within the earth. As such high pressure pockets are punctured by the drill bit, the pressure is released and may exert a force that causes the oil or gas to rapidly move up the bore hole. The blowout preventer 110 is constructed to prevent such oil or gas such from exiting the top of the bore hole. The blowout preventer has multiple types of valves that can be shut to prevent the oil or gas from exiting the bore hole. In some cases, shutting off the valves damages the drill pipe. The force exerted by such high pressure pockets can be significant. To counteract such forces, the blowout preventers 110 often weigh tens of thousands of pounds. Thus, moving the blowout preventer 110 as a single unit during the drill rig's setup involves the use of equipment that is easy to control and reliable.

In the examples depicted in the figures, a first trolley structure 149 is attached to the first box substructure 112, and a second trolley structure 150 is attached to the second box substructure 114. The trolley structures 149, 150 may be permanently attached to the box substructures 112, 114 including during transportation. A first hoist may be connected to the first trolley structure 149, and a second hoist may be connected to the second trolley structure 150. The hoists may be used to lift and position the blowout preventer 110 and other types of equipment during the assembly and disassembly of the drill rig 100.

Figure 3:
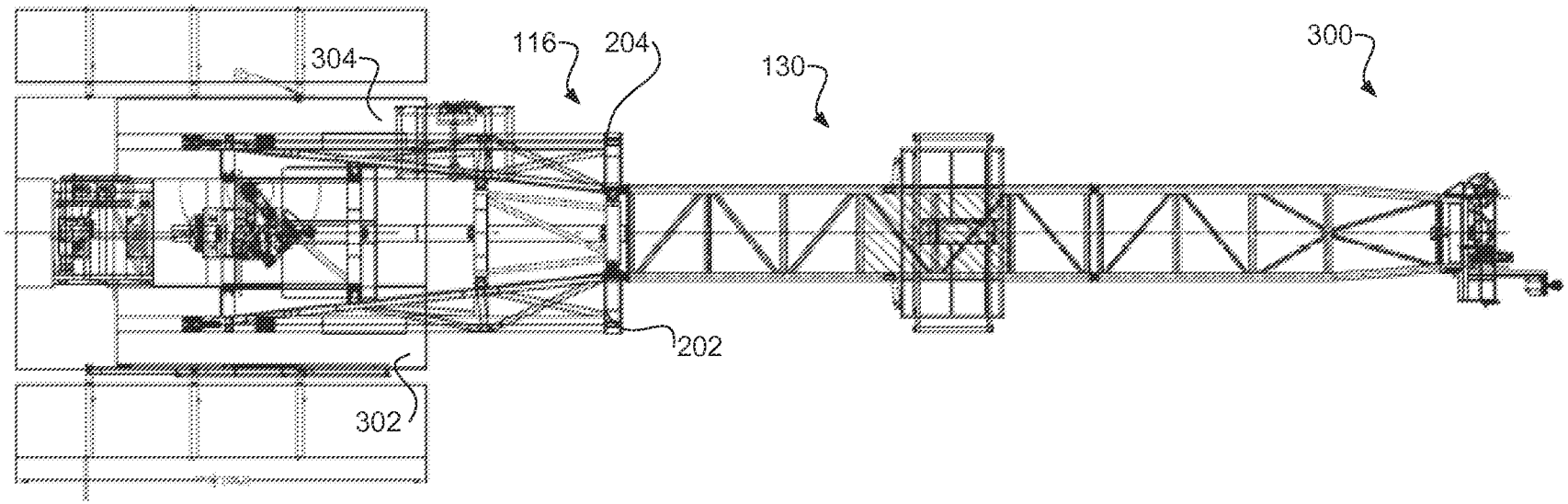
FIG. 3 illustrates a top view of an example of a drill rig with a lowered mast in accordance with the present disclosure.
Figure 4:
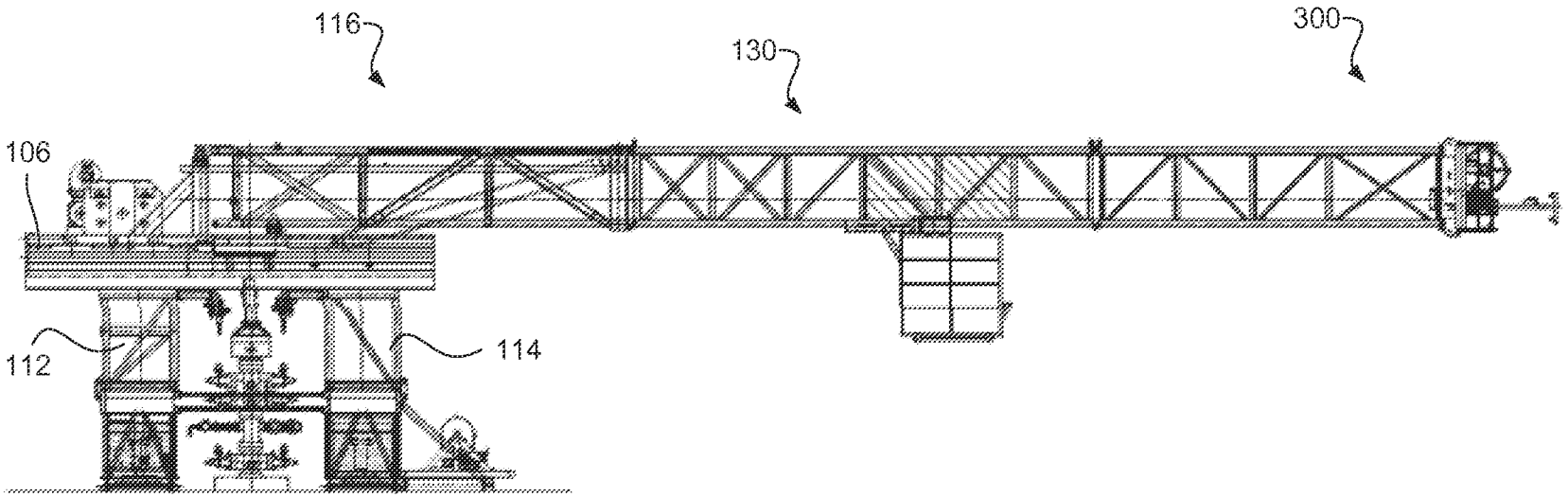
FIG. 4 illustrates a side view of an example of a drill rig with a lowered mast in accordance with the present disclosure.
Figure 5:
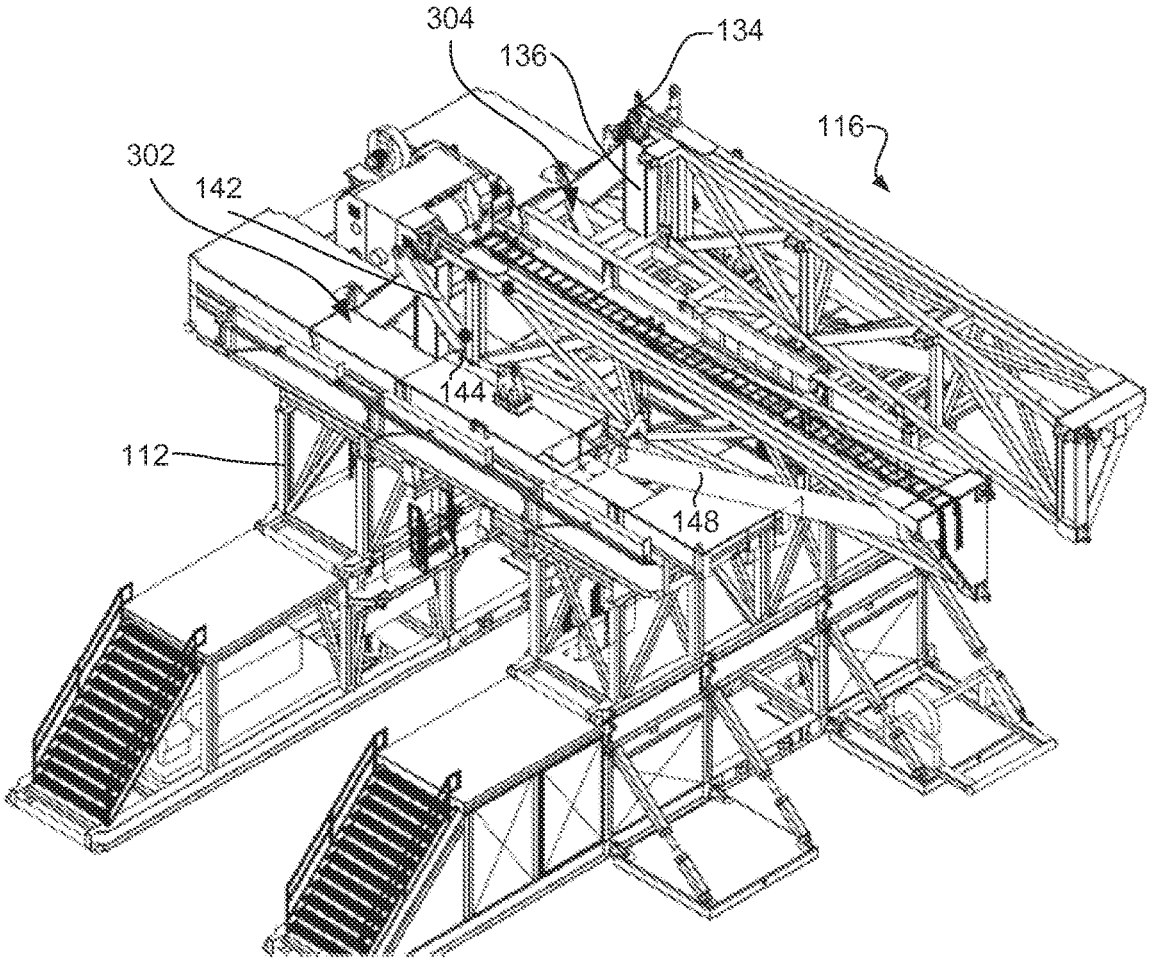
FIG. 5 illustrates a perspective view of an example of a drill rig with a lowered mast in accordance with the present disclosure.

FIGS. 3-5 depict the drill rig 100 with the mast 102 in a lowered position. In the examples, of FIGS. 3-4, the mast assembly includes the lower mast section 116, the middle mast section 130, and a top mast section 300. In some examples, the entire mast 102, is lower and raised with all the sections 116, 130, 300 in place. In such examples, the top mast section 300 and the middle mast section 130 may be added or removed while the mast 102 is lowered. FIG. 5 depicts the drill rig 100 with the middle and top mast sections 130, 300 removed.

Also, each of the mast subsections 202, 204 is attached to individual mast transport skids. For example, the driller's side mast subsection 202 is attached to a driller's side mast transport skid 302, and the off driller's side mast subsection 204 is attached to an off driller's side mast transport skid 304. In some examples, a single cylinder is used to raise both of the mast subsections 202, 204 when the mast subsections 202, 204 are connected by the spreader beams 206. In other examples, each of the mast subsections 202, 204 include an individual cylinder. The front mast leg supports 142 are depicted in a rotated position where the front mast leg supports 142 are moved closer to the lower mast section 116 than previously when the front mast leg supports 142 are in their operational position. In the illustrated example, a joint 144 connects the front mast leg 140 and the front mast leg support 142. The joint 144 may be a rotary joint that allows the front mast leg support 142 to freely rotate while staying connected to the front mast leg 140. The support connector 306 is also depicted in the mast transport skid 106. When the front mast leg support 142 is connected to the support connector 306, the front mast leg support 142 is bound at both the first and second ends preventing the front mast leg support 142 from rotating and bares the weight of the mast 102. However, when the front mast leg support 142 is disconnected from the support connector 306, the front mast leg support 142 can pivot out of the way to allow the mast 102 to be lowered.

As described above, the drill rig 100 may be disassembled into transportable units to carry the components of the drill rig 100 to a new drill site. In some examples, the top mast section forms a transportable unit, and the middle mast section forms a different transportable unit. Likewise, the first box substructure 112 may form a transportable unit, and the second box substructure 114 may form another transportable unit. Also, the driller's side mast transport skid 302 along with the driller's side subsection 202 of the lower mast section 116, and their associated cylinder 148 may form a transportable unit. Likewise, the off driller's side mast transport skid 304 along with the off driller's side subsection 204 of the lower mast section 116, and their associated cylinder 148 may form another transportable unit. Each of the transportable units may be transported independently on truck trailers and be within government regulations and industry standards.

For each of the mast transport skid transportable units, the cylinders 148 may remain attached to both the mast transport skid 106 and the lower mast subsection during transport. Keeping the first and second ends of the cylinders 148 attached to the mast transport skids 302, 304 and the appropriate mast subsections 202, 204 provides multiple advantages. One advantage is that the cylinder 148 is already in position to raise the mast 102 once the mast transport skids 302, 304 are secured to the substructures 112, 114.

Figure 6:
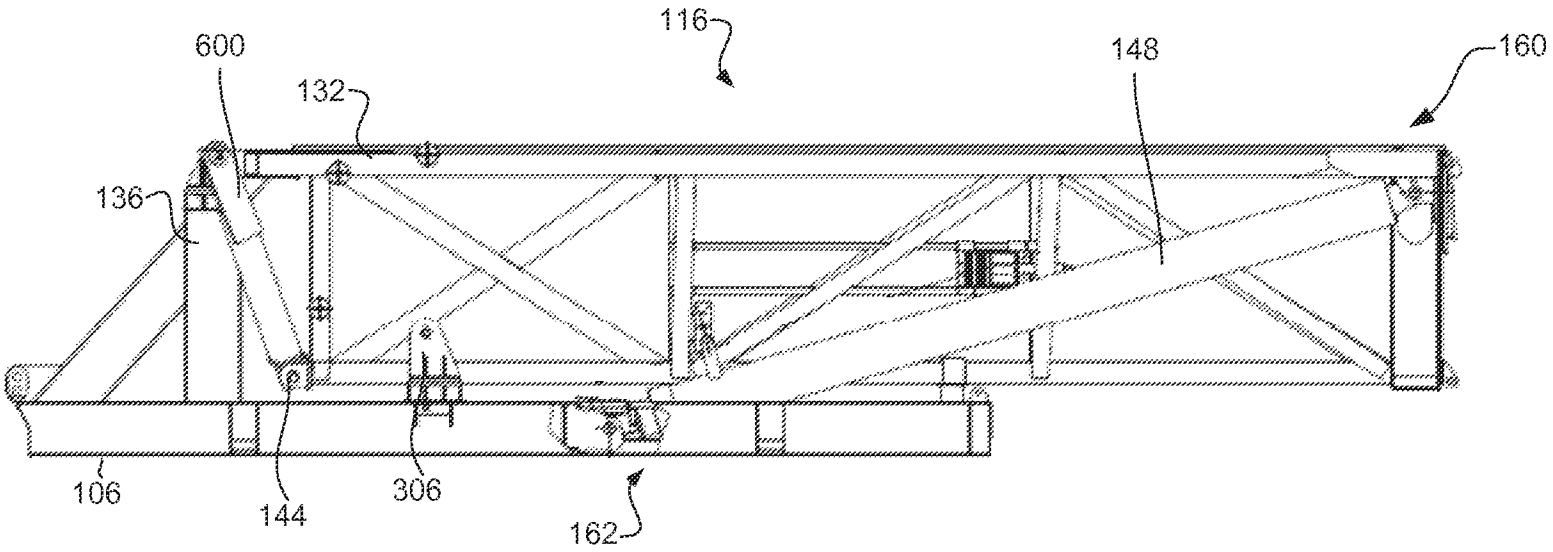
FIG. 6 illustrates a side view of a transportable unit in accordance with the present disclosure.
Figure 7:
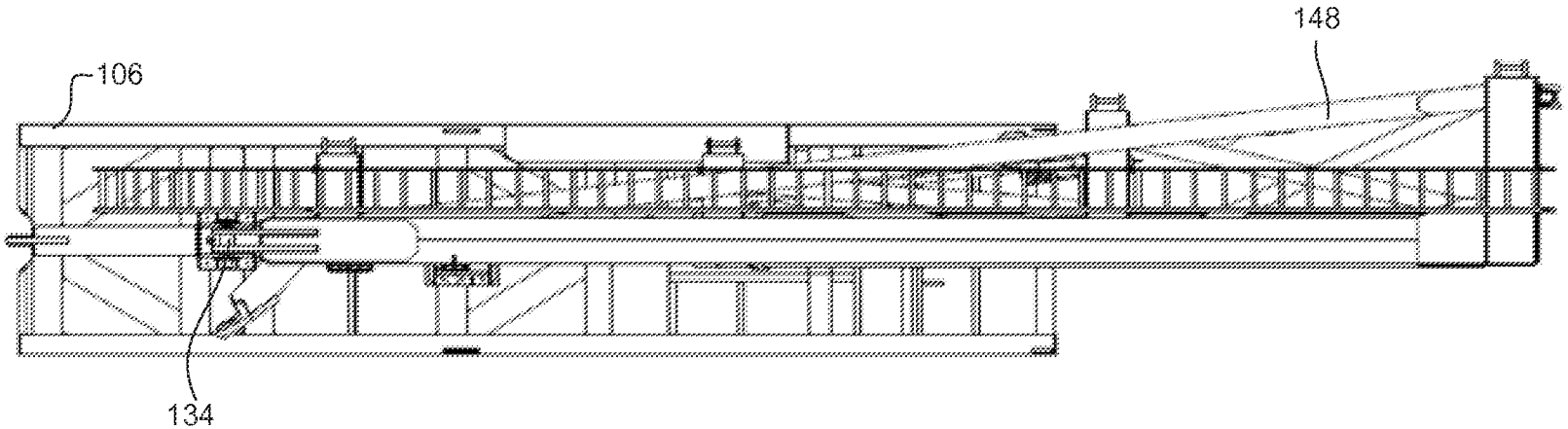
FIG. 7 illustrates a top view of a transportable unit in accordance with the present disclosure.
Figure 8:
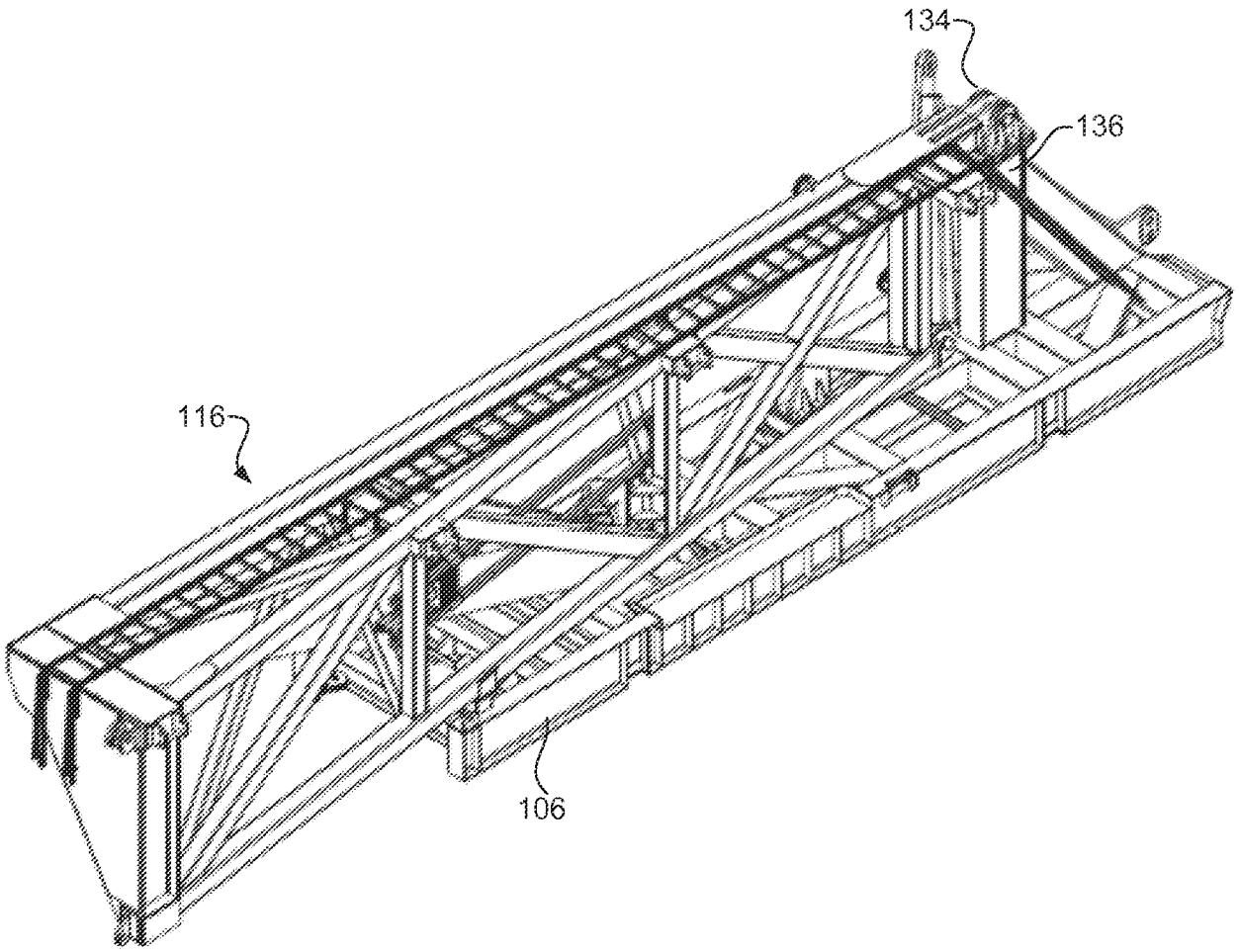
FIG. 8 illustrates a perspective view of a transportable unit in accordance with the present disclosure.

FIGS. 6-8 depict an example of the transportable units that include the mast transport skid 106, the cylinder 148, and the lower mast section 116. As described above, during transportation, the first end of the cylinder 148 is attached to the lower mast section 116, and the second end 162 of the cylinder 148 is attached to the mast transport skid 106. The connection between the second end 162 of the cylinder 148 and the mast transport skid 106 may be a pin connection where the second end 162 of the cylinder 148 may be unpinned after the cylinder 148 has raised the mast 102 during the set-up of the drill rig 100.

During transport, the back legs 132 continue to be connected to the pivot connector 134 that is elevated off of the floor of the mast transport skid 106 with the pivot supports 136. The mast 102 pivots about the pivot connector 134 when the mast 102 is being raised and lowered. Thus, a set-up crew does not have to reconnect the lower mast section 116 to the pivot support 136 during set-up which further reduces the amount of time needed to assemble the drill rig 100.

Also, during transport, the front mast leg support 142 remains connected to the front mast leg 140 at the joint 144. A releasable end 600 of the front mast leg support 142 is rotated towards the pivot support 136 during transport. During assembly of the drill rig 100, the front mast leg support 142 is rotated back into an upright position simultaneously as the mast 102 is raised. This may be accomplished with a pulley/cable system that moves the front mast leg support 142 into place as the cylinder 148 extends. In other examples, the front mast leg support 142 is moved into place manually. However, any appropriate mechanism for moving the front mast leg support 142 into place may be used in accordance with the principles described in the present disclosure. When the front mast leg support 142 is in the proper position, the releasable end 600 of the front mast leg support 142 can be connected to the support connector 306 incorporated into the mast transport skid 106.

Figure 9:
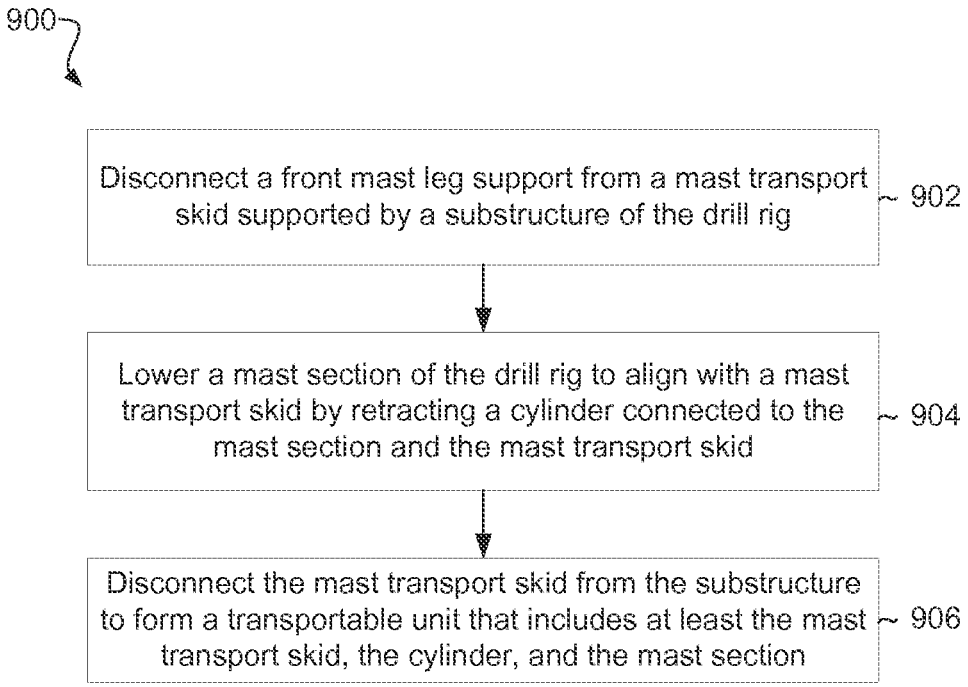
FIG. 9 illustrates a method of an example of disassembling a drill rig in accordance with the present disclosure.

FIG. 9 illustrates a method 900 of an example of disassembling a drill rig in accordance with the present disclosure. In this example, the method 900 includes disconnecting 902 a front mast leg support from a mast transport skid supported by a substructure of the drill rig, lowering 904 a mast section of the drill rig to align with a length of a mast transport skid by retracting a cylinder connected to the mast section and the mast transport skid, and disconnecting 906 the mast transport skid from the substructure to form a transportable unit that includes at least the mast transport skid, the cylinder, and the mast section. In some examples, the transportable unit may include a strong back of the drill rig as well.

At block 902, the front mast leg support is disconnected from the mast transport skid. The front mast leg support may be pinned to a support connector incorporated into the mast transport skid during drilling operations. In such examples, the front mast leg support may be unpinned from the support connector at a first end while remaining connected to the front mast leg at the other end. With the front mast leg support disconnected from the mast transport skid, the mast is just connected to the mast transport skid through the pivot connector made between the pivot support and the back legs of the mast and the cylinder. With the front mast leg support disconnected, the mast is free to rotate about the pivot connector when the cylinder retracts.

While this example has been described with reference to the front mast leg being connected to the mast transport skid at a support connector with a pin, any appropriate type of connection between the mast transport skid and the front mast leg support may be used in accordance with the present disclosure. For example, in some examples, a threaded connection between the front mast leg support and the mast transport skid is used. In yet other examples, the connection may include chains, threads, nuts, magnets, snaps, hooks, anchors, fasteners, other types of connectors, or combinations thereof.

At block 904, the mast section is lowered so that the mast section aligns with the mast transport skid. Lowering the mast may occur through retracting the cylinder that is connected to both the mast transport skid and the mast. In some examples, the height of the pivot connector is between 8.0 feet and 12.0 feet. In yet other examples, the height is about 10.0 feet.

The cylinder may be positioned to lower the mast so that the front side of the mast faces downward after the mast is lowered. The mast may be lowered by rotating the mast about the mast's back legs which are elevated above the mast transport skid. With the mast in the transport position, the mast may be aligned with the mast transport skid with the back legs elevated to a height of the pivot connector. Further, when the mast is in the transport position, the thickness of the mast may occupy the space between the mast transport skid and the pivot connector.

In some examples, the front leg mast support rotates out of the way at the same time that the cylinder lowers the mast. The movement of the front mast leg support may occur automatically in response to movement of the mast. In some cases, a cable and pulley system is used to move the front mast leg support. However, any appropriate mechanism may be used to move the front mast leg support. In some scenarios, the joint of the front mast leg support and the front mast leg may be geared to the pivot connector such that the joint causes the front mast leg support to move as the mast is rotated about the pivot connector. In alternative examples, a sensor that detects movement of the mast at the pivot connector is in communication with the joint. Signals from the sensor indicating movement of the mast can include commands to move the front mast leg support. Such communications may be hardwired or wireless. In yet other examples, support cylinders move the front leg mast support or the front mast leg supports are moved manually or with hydraulic cylinders.

In examples where several mast sections are lowered by the cylinder, one or more of the mast sections may be removed from the mast assembly when the mast is in the aligned orientation. For example, a top mast section and a middle mast section may be removed from the mast leaving just the lower mast section connected to the mast transport skid. In other examples, portions of the mast are disconnected before lowering the mast. In yet other examples, the mast is made more compact so that additional sections of the mast may be transported with the mast transport skid. In such examples, the sections of the mast may telescope or otherwise move into the lower mast section. In yet other examples, the entire mast assembly remains with the mast transport skid.

At block 906, the mast transport skid is disconnected from the substructure. The mast transport skid may be detached from a beam that spans the distance between two substructure columns. Such substructure columns may include box on box substructure arrangements or another type of appropriate substructure arrangement. In some examples, the mast transport skid is connected to the beam with clamps, pins, other fasteners, or combinations thereof. These fasteners may be undone to remove the mast transport skid with the cylinder and mast section to form the transportable unit.

Figure 10:
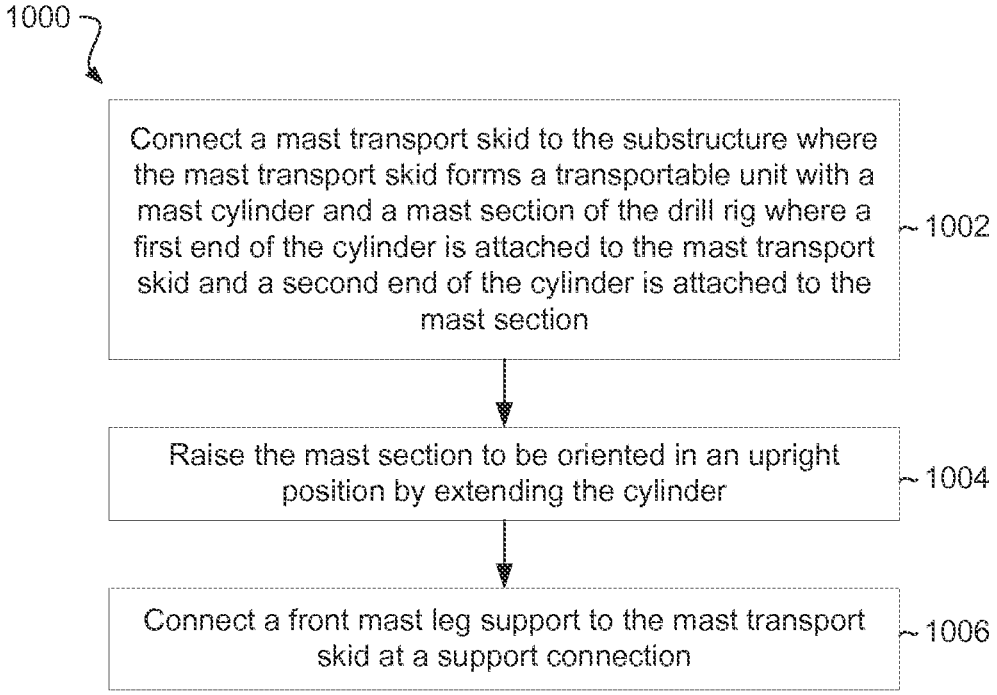
FIG. 10 illustrates a method of an example of assembling a drill rig in accordance with the present disclosure.

FIG. 10 illustrates a method 1000 of an example of assembling a drill rig in accordance with the present disclosure. In this example, the method 1000 includes connecting 1002 a mast transport skid to the substructure where the mast transport skid forms a transportable unit with a mast cylinder and a mast section of the drill rig where a first end of the cylinder is attached to the mast transport skid and a second end of the cylinder is attached to the mast section, raising 1004 the mast section to be oriented in an upright position by extending the mast cylinder, and connecting 1006 a front leg support to the mast transport skid at a support connector.

At block 1002, the mast transport skid is connected to the substructure of the drill rig. In some cases, the substructure portion connects to a beam that spans the distance between the substructure columns as described above. However, the mast transport skid may be attached to any appropriate portion of the substructure.

In some examples, the driller's side mast transport skid and the off driller's side mast transport skid are connected separately to the substructures such that each of the mast transport skids both span the distance between the substructure columns. In such cases, the mast subsections may be linked to each other by connecting spreader beams that connect the mast subsections. The mast transport skids may be connected to the substructures with any appropriate type of substructure connector. For example, the mast transport skids may be bolted into substructures. In other examples, the mast transport skids are pinned to the substructures. In yet other examples, the mast transport skids are clamped and/or locked in place on top of the substructures.

At block 1004, the mast sections are raised to be oriented in an upright position by extending the cylinder. In cases where the mast subsections of the driller's side mast transport skid and the off driller's side mast transport skid are linked together, both of the cylinders may be actuated together to raise the mast subsections at the same rate.

At block 1006, the front mast leg support is connected to the skid at a support connector. The support connector may be any appropriate type of connection that is incorporated into the mast transport skid. Also, the front mast leg support may be moved into an operational position to attach to the support connector simultaneously as the mast is raised by the cylinders. However, any appropriate mechanism for moving the front mast leg supports to the support connectors may be used in accordance with the principles described herein.

While the examples above have been described with specific reference to just the lower mast section being connected to the mast transport skid during transport, any appropriate part of the mast may be included in the transportable unit. For example, a middle section of the mast and/or the top section of the mast may be included as part of the transportable unit. In such cases, the different sections of the transportable unit may collapse, telescope, or otherwise be joined in a compact arrangement to meet size and dimension requirements for government regulations and industry standards during transportation.

Also, while the examples described above have been depicted in the figures with reference to specific locations where the cylinder 148 connects to the mast 102 and to the mast transport skid 106, the cylinders 148 may connect to the mast 102 and mast transport skid 106 at any appropriate location. For example, the cylinder 148 may connect at an end of the mast transport skid 106, in the middle of the mast transport skid 106, on a side of the mast transport skid 106, another location of the mast transport skid 106, to an attachment of the mast transport skid 106, or combinations thereof. Similarly, the cylinder 148 may connect to a top of the lower mast section 116, to a side of the lower mast section 116, to a middle of the lower mast 102, to a top of the mast 102, to a beam of the mast 102, a bottom of the lower mast section 116, another region of the mast 102, or combinations thereof.

What is claimed is:

1. A transportable unit forming a portion of a drill rig, the transportable unit, comprising:

a mast transport skid of the transportable unit;

a drill rig mast of the transportable unit pivotally attached to the mast transport skid;

a cylinder of the transportable unit with a first cylinder end attached to the mast transport skid and a second cylinder end attached to the drill rig mast;

the mast transport skid having a pivot connector attached to a first mast leg of the drill rig mast;

the mast transport skid also comprising a support connector to attach to a second mast leg support of the drill rig mast; and the mast transport skid also comprising a substructure connector to attach to a substructure of the drill rig;

wherein the mast transport skid, the drill rig mast, and the cylinder are connected as a single unit during transport.

2. The transportable unit of claim 1, wherein the cylinder is a single stage cylinder.

3. The transportable unit of claim 1, wherein the pivot connector is elevated between 5.0 and 15.0 feet above a floor of the mast transport skid by a pivot support.

4. The transportable unit of claim 1, wherein the second mast leg support is connected to a second leg of the drill rig mast at a joint at a first support end when a second support end of the second mast leg support is rotated towards the drill rig mast.

5. The transportable unit of claim 1, wherein the transportable unit is configured to be transported as a single unit on a single truck trailer.

6. A transportable unit, comprising:

a skid of the transportable unit;

the skid having a pivot connector to pivotally attach to a first mast leg of a drill rig mast of the transportable unit;

the skid also comprising a support connector to attach to a second mast leg support of the drill rig mast; and the skid also comprising a substructure connector to attach to a substructure of a drill rig;

wherein the skid, the drill rig mast, and a cylinder are connected as a single unit during transport.

7. The transportable unit of claim 6, wherein the skid also comprises a cylinder attachment to connect a first end of the cylinder, where a second end of the cylinder is connected to the drill rig mast.

8. The transportable unit of claim 6, wherein the cylinder has a first cylinder end attached to the skid and a second cylinder end attached to the drill rig mast.

* * * * *